US010746503B2

(12) United States Patent
Bittner et al.

(10) Patent No.: US 10,746,503 B2
(45) Date of Patent: Aug. 18, 2020

(54) LAUNCHER DEVICE AND LAUNCHER BATTERY

(71) Applicant: DIEHL DEFENCE GMBH & CO. KG, Ueberlingen (DE)

(72) Inventors: Markus Bittner, Reichenschwand (DE); Thomas Leidenberger, Nuremberg (DE)

(73) Assignee: Diehl Defence GmbH & Co. KG, Ueberlingen (DE)

( * ) Notice: Subject to any disclaimer, the term of this patent is extended or adjusted under 35 U.S.C. 154(b) by 0 days.

(21) Appl. No.: 16/415,059

(22) Filed: May 17, 2019

(65) Prior Publication Data

US 2019/0353453 A1 Nov. 21, 2019

(30) Foreign Application Priority Data

May 17, 2018 (DE) ..... 10 2018 003 958

(51) Int. Cl.
*F41F 3/077* (2006.01)
*F41F 3/042* (2006.01)

(52) U.S. Cl.
CPC ..... *F41F 3/077* (2013.01); *F41F 3/042* (2013.01)

(58) Field of Classification Search
CPC ..... F41F 3/10; F41F 3/073; F41F 3/07; F41F 3/052; F41F 3/045; F41F 3/04; F41F 3/042; F41F 3/077
USPC ..... 89/1.817
See application file for complete search history.

(56) References Cited

U.S. PATENT DOCUMENTS

| | | | | |
|---|---|---|---|---|
| 4,373,420 | A * | 2/1983 | Piesik | F41F 3/0413 89/1.812 |
| 6,152,011 | A * | 11/2000 | Ivy | F41A 19/68 102/217 |
| 6,230,604 | B1 * | 5/2001 | Larson | F41F 3/0413 89/1.812 |
| 7,624,669 | B2 * | 12/2009 | Paul | F41F 3/052 89/1.806 |
| 8,191,454 | B2 * | 6/2012 | Dupont | F41F 3/04 89/1.812 |
| 8,950,308 | B2 * | 2/2015 | Wallis | E05D 7/081 49/61 |
| 9,704,357 | B2 * | 7/2017 | Hasbach | B65D 79/02 |
| 2007/0146132 | A1 * | 6/2007 | Krug | G08B 13/08 340/553 |

FOREIGN PATENT DOCUMENTS

| | | | |
|---|---|---|---|
| DE | 2946002 | A1 | 5/1981 |
| DE | 102008022867 | B4 | 1/2010 |
| DE | 102014004377 | B4 | 7/2017 |
| EP | 2506228 | A1 | 10/2012 |
| GB | 2290856 | A | 1/1996 |
| JP | H11287598 | A | 10/1999 |

* cited by examiner

*Primary Examiner* — John Cooper
(74) *Attorney, Agent, or Firm* — Laurence A. Greenberg; Werner H. Stemer; Ralph E. Locher

(57) ABSTRACT

A launcher device for launching ammunition or weapons provided with primers, contains a plurality of launch tubes combined so as to form a launcher battery. Each of the launch tubes is loaded with ammunition or a weapon, and each of the launch tubes is closed off by a cover. A device is provided for detecting damage to the covers closing off the launch tubes.

24 Claims, 4 Drawing Sheets

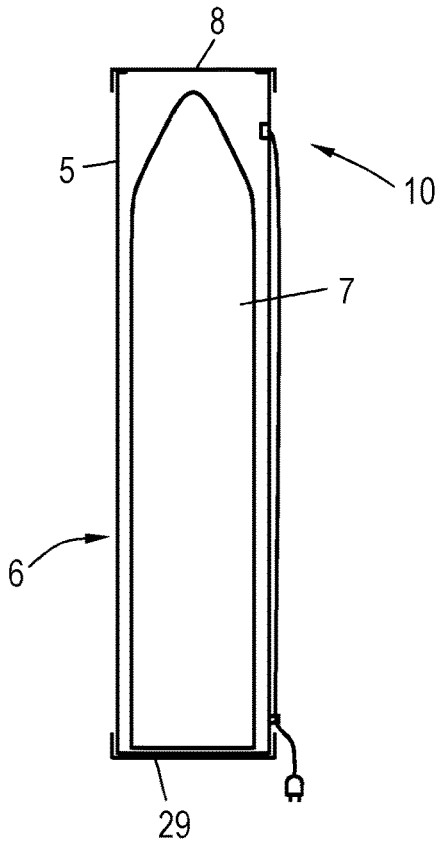
FIG. 3
FIG. 4
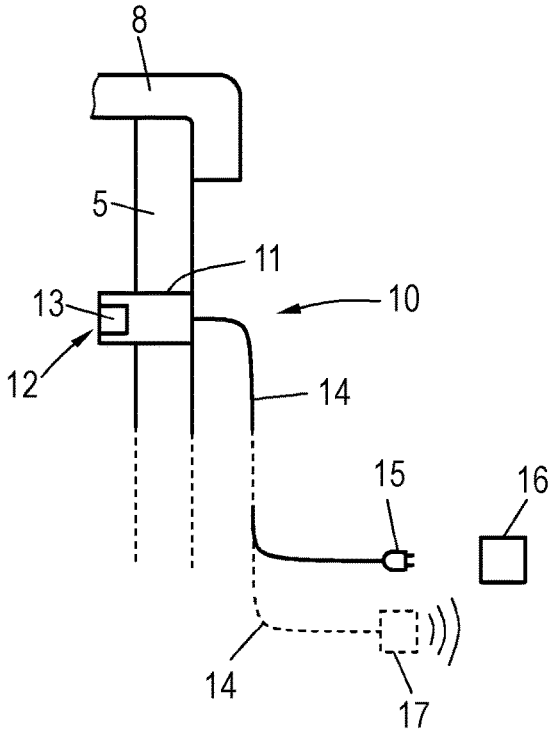
FIG. 5
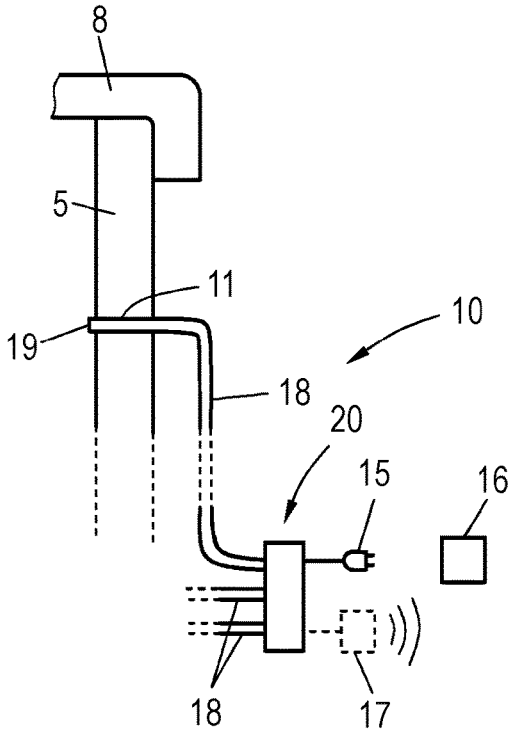

LAUNCHER DEVICE AND LAUNCHER BATTERY

CROSS-REFERENCE TO RELATED APPLICATION

This application claims the priority, under 35 U.S.C. § 119, of German application DE 10 2018 003 958.8, filed May 17, 2018; the prior application is herewith incorporated by reference in its entirety.

BACKGROUND OF THE INVENTION

Field of the Invention

The invention relates to a launcher device for launching ammunition or weapons provided with primers, containing a plurality of launch tubes combined so as to form a launcher battery, each of which launch tubes is loaded with ammunition or a weapon, and each of which launch tubes is closed off by a cover.

Such a launcher device allows rapid firing for example of missiles that are gathered in a launcher battery. To this end, the launcher battery contains a plurality of launch tubes, each of which is equipped with a missile, for example. The launcher battery, which is inserted as a preassembled unit into a corresponding apparatus of the launcher device, which is for example mounted on a vehicle, contains a plurality of, for example six, separate launch tubes. These are securely closed off by a cover in order to protect the inserted ammunition. To fire a missile, its primer is ignited, whereupon the missile is fired out of the launch tube. The problem may occur here that a cover of an adjacent launch tube of the launcher battery may be damaged or destroyed by the discharge jet from the missile fired in the individual shot or by churning up of the ground surface or the like. This may result in considerable danger due to incorrect transitional ballistics of the missile associated with this launch tube closed off by the damaged or destroyed cover. By way of example, the missile may miss its target by a considerable extent, it may leave the exercise area when exercise ammunition is fired, or the like.

Up until now, it has been sought to use video recordings, recorded using an external camera, that is to say one positioned sufficiently far from the vehicle, during firing for example when firing exercise missiles, to detect any damage to adjacent closure covers in an optical manner, that is to say by viewing the images. In particular when firing exercise ammunition, a visual inspection may also be performed by personnel. Independently of which checking variant is selected, rapid rounds of firing, such as for example a burst of shots, that is to say multiple shots in a short sequence, are not possible for this reason.

SUMMARY OF THE INVENTION

The invention is therefore based on the problem of specifying a launcher device that is improved in comparison.

To solve this problem, in the case of a launcher device of the type mentioned at the outset, it is provided, according to the invention, that a device for detecting damage to the covers closing off the launch tubes is provided.

According to the invention, the launcher device is distinguished by a device, provided thereon, which is to say integrated on the launcher device side, for detecting any damage to such a cover. Using this device, it is able to be detected, virtually immediately after firing ammunition or a corresponding weapon, whether one or more adjacent covers have been affected, such that, on the basis of this information, either further firing may be continued, or else firing of further ammunition is prohibited until an accurate check has been carried out or any exchange of the launcher battery has been performed. Since the device automatically delivers the corresponding information immediately after firing, in the case of undamaged covers, it is therefore possible to be able to fire rapid rounds of shots, such that this may also be performed either in an exercise scenario or in a real scenario. The disadvantages mentioned at the outset are therefore advantageously no longer present in the launcher device according to the invention.

One particularly expedient configuration of the invention provides that the device is configured to detect an incidence of light into the respective launch tube resulting from damage to the cover. Each launch tube is hermetically closed off, the closure being implemented on one side, specifically by this cover. If the cover is then damaged, that is to say for example a hole is burned in or driven in or the like, then light may penetrate into the respective launch tube through this damage site. This incidence of light may be ambient light if firing is performed during the day. It may however also be light emitted by the burning primer of the missile that has just been fired. If the light-sensitive detection device then detects such an incidence of light, a certain detection of damage is possible.

According to a first alternative of the invention, the device for detecting any incidence of light may be based on sensor elements. That is to say, at least one sensor element detecting an incidence of light is provided in each launch tube, which sensor element communicates with a control and/or display device external to the tube. According to the invention, a light-sensitive sensor element is thus installed in the respective launch tube, which sensor element accordingly communicates with a control and/or display device, external to the tube, to which the corresponding sensor data are supplied. Depending on the detected result, in the case of a coupling to a control device, it is possible either to continue the automatically controlled firing operation or, in the event of detecting damage, to interrupt it. A corresponding for example optical display as to whether damage-free or damaging firing has taken place is also possible on the display device, for example a corresponding monitor.

As an alternative to integrating a sensor element on the launch tube side, it is also conceivable to arrange an optical waveguide in each launch tube or to insert one into said launch tube, which optical waveguide is connected to a sensor element detecting an incidence of light, which sensor element communicates with a control and/or display device external to the tube. According to this configuration of the invention, the sensor element is thus not integrated directly into the tube, but rather is arranged externally with respect to the launch tube. Starting from the sensor element, an optical waveguide runs into the inside of the tube. Incident light may be guided to the sensor element through this optical waveguide, which sensor element then supplies a corresponding signal to the control and/or display device. If the cover is undamaged, no signal is supplied, such that firing may be continued.

In the case of such an optical waveguide arrangement, it is conceivable for each optical waveguide to be connected to a separate sensor element. In this configuration, each waveguide (it is sufficient for one waveguide to be assigned to a launch tube) thus guides to a separate sensor element. Each sensor element is then suitably coupled to the control and/or display device so as to be able to communicate. As an alternative, it is conceivable for several or all of the waveguides to be connected to a common sensor element. The sensor element is then able to resolve any signals from the individual optical waveguides, such that it is not only detected that a cover is damaged, but there is also differentiation as to which cover is damaged.

A photodiode, that is to say an electronic component that allows highly sensitive signal detection and therefore highly sensitive incidence of light detection, is preferably used as sensor element.

Assigning individual sensor elements to the individual launch tubes or individual optical waveguides to the individual launch tubes, and therefore separately detecting the state or functional status of each individual launch tube, is in particular expedient in that knowledge is thereby obtained as to which launch tube is no longer able to be used due to any cover damage. The control device is then able for example, in the case of a launcher battery containing six launch tubes, to decide which of the for example five remaining missiles are still able to be fired. These launch tubes may then be driven accordingly, and the launch tube having the defective cover is no longer driven.

As explained, the respective sensor element should be arranged in the launch tube, and likewise, the optical waveguide should be inserted into the launch tube. This is expediently carried out on or in the tube wall, wherein the sensor element or the optical waveguide are preferably arranged adjacent to the cover or open out adjacent to the cover in the case of the optical waveguide. The photodiode may for example be inserted into a small recess in the tube wall, and the optical waveguide may for example open out flush with the tube wall. The arrangement as close as possible to the cover is expedient as the incidence of light occurs here, such that even very slight damage or open sites at which only a very small amount of light is incident are still able to be detected with certainty.

The sensor element or sensor elements may communicate with the control and/or display device in a wired manner. That is to say that they are connected, via a corresponding connecting cable, to the control and/or display device, which is provided for example in the driver's cabin of the vehicle on which the launcher device is installed. As an alternative, wireless communication with the control and/or display device is also possible, for example via a Bluetooth connection or another wireless communication standard. As explained, the logic is such that, on the side of the control and/or display device, it is unambiguously detected and output which launch tube has already been fired, such that in turn it is also unambiguous which sensor element signal is no longer relevant. This is because sensor elements of launch tubes that have already been fired, whose covers are necessarily open, naturally continuously deliver a corresponding signal. These signals may then accordingly be suppressed or not taken into account, such that only the signals from the sensor elements that are assigned to launch tubes that have not yet been fired are still taken into account.

In the case of wired communication, the wired communicating sensor element or sensor elements may be connected to a common connector device via connecting lines, which connector device is able to be connected releasably to a second connector device that is connected to the control and/or display device via a connecting line. A corresponding line coupling is thus provided.

In this case, the two connector devices may need to be connected manually, that is to say, when the launcher battery is inserted, the corresponding connectors are manually plugged together by the personnel. As an alternative, it is conceivable for the two connector devices also to be able to be connected automatically when the launcher battery is inserted into a battery receptacle that is part of the launcher device. An automatic line coupling according to the "plug and play" principle thus takes place, and any manual connection tasks are not necessary according to this configuration.

In the case of wireless communication, it is conceivable for the wirelessly communicating sensor element or sensor elements to be connected to a transmission device, provided on the launcher battery, using which transmission device the sensor signals are able to be transmitted to the control and/or display device or a reception device assigned thereto. In this case, the communication thus takes place through a corresponding transmission and reception arrangement.

As described, it is expedient for the or a control and/or display device detecting or indicating any damage to be arranged in a driver's cabin of a vehicle transporting the launcher battery. By way of this, the driver or the shooter operating the launcher device, protected in the driver's cabin, is able to obtain and process the corresponding information, or take action in the case of appropriate information content.

The type of this action may in this case vary depending on how the launching operation is controlled. Upon detection of damage to a cover, the further launching operation may automatically be interrupted. In this case, the control and/or display device automatically intervenes in the further firing operation and automatically stops it. This interruption may be overridden again for example following a corresponding inspection by personnel, and firing may be continued, or the like. As an alternative, it is also conceivable for the further launching operation to be interrupted manually. In this case, the shooter obtains for example a corresponding item of image or text information on the display device, and may then intervene on the controller side and interrupt the further launching operation.

In addition to the launcher device itself, the invention furthermore relates to a battery for such a launcher device. The battery contains a plurality of combined launch tubes, each of which is loaded with ammunition or a weapon, and each of which is closed off by a cover. The launcher battery is distinguished in that a device for detecting damage to the covers closing off the launch tubes is provided.

According to one particularly advantageous development of the invention, this device is configured to detect an incidence of light into the respective launch tube resulting from damage to the cover. To this end, at least one sensor element detecting an incidence of light may be provided in each launch tube, which sensor element communicates with a control and/or display device external to the tube. As an alternative, an optical waveguide may also be arranged in each launch tube or guided therein, which optical waveguide is connected to a sensor element detecting an incidence of light, which sensor element again communicates with a control and/or display device external to the tube.

In this case, each optical waveguide may be connected to a separate sensor element, or, as an alternative, several or all of the optical waveguides may also be connected to a common sensor element, this resulting in a bundle.

A photodiode is preferably used as sensor element, other light-sensitive sensor elements also being able to be used, however.

The sensor element or the optical waveguide is expediently arranged on or in the tube wall, preferably adjacent to the cover, such that even a very small incidence of light is able to be detected with certainty.

The sensor element or sensor elements may furthermore be assigned communication means for wired or wireless communication with an external control and/or display device. Signal communication is possible through these communication means.

In the case of wired communication, the wired communicating sensor element or sensor elements may be connected to a common connector device via connecting lines, which connector device is able to be connected releasably to a second connector device that is connected to the control and/or display device via a connecting line. The wired connection or line connection may either need to be closed manually, that is to say that the first connector device is configured for manual connection, or as an alternative the first connector device may also be designed for automatic connection when inserting the launcher battery into a battery receptacle.

In the case of wireless communication, the sensor elements may be connected to a transmission device, using which the sensor signals are able to be transmitted to the control and/or display device or a reception device assigned thereto.

Other features which are considered as characteristic for the invention are set forth in the appended claims.

Although the invention is illustrated and described herein as embodied in a launcher device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3 is a plan view of a launch tube with an inserted missile and a detection device arranged thereon;

FIG. 4 is a partial view of the launch tube having a cover arranged thereon and a sensor element integrated on the tube side;

FIG. 5 is a partial view corresponding to FIG. 4, but with an optical waveguide integrated on the tube side;

DETAILED DESCRIPTION OF THE INVENTION

Figure 1:
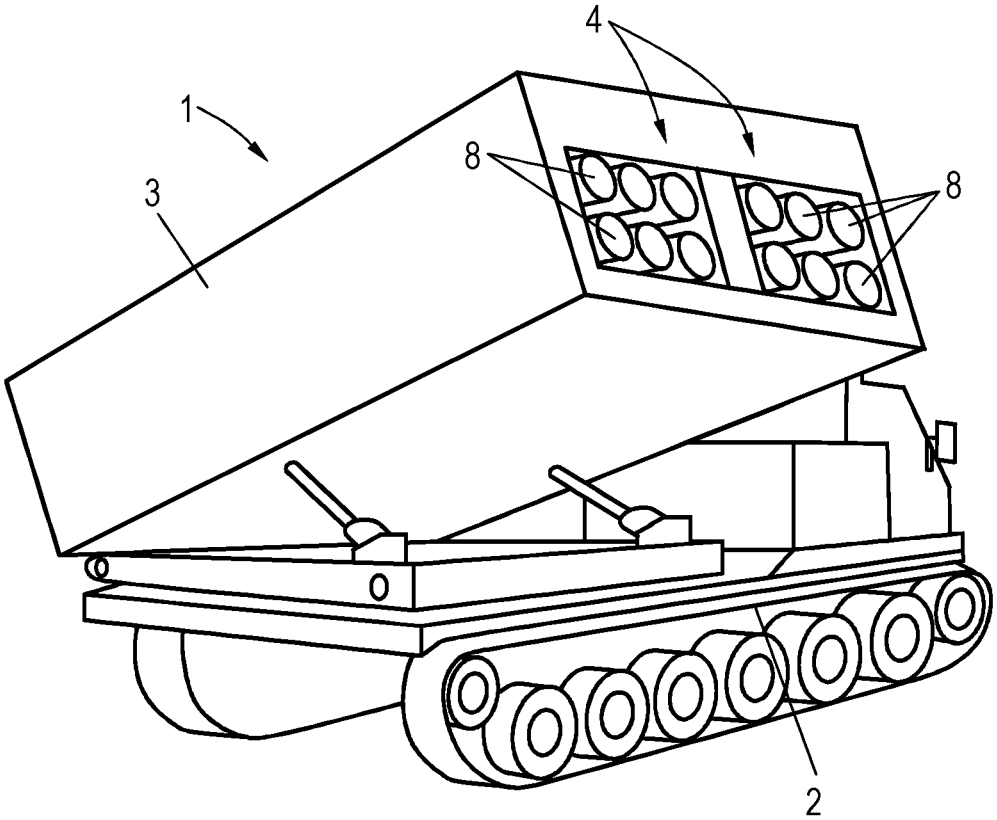
FIG. 1 is a diagrammatic, perspective view of a launcher device according to the invention.

Referring now to the figures of the drawings in detail and first, particularly to FIG. 1 thereof, there is shown a launcher device 1 according to the invention, having a vehicle 2, in this case a track vehicle, having an receptacle device 3 placed on top thereof for two launcher batteries 4 in the example shown. The launcher battery 4 is shown in an enlarged illustration in FIG. 2. It contains six separate launch tubes 5, which are each equipped with ammunition 6, a missile 7 in the example shown, see for example FIG. 3. The launch tubes 5 are hermetically closed off on both sides by corresponding covers 8, that is to say hermetically sealed, such that the ammunition 6 is protected.

Figure 2:
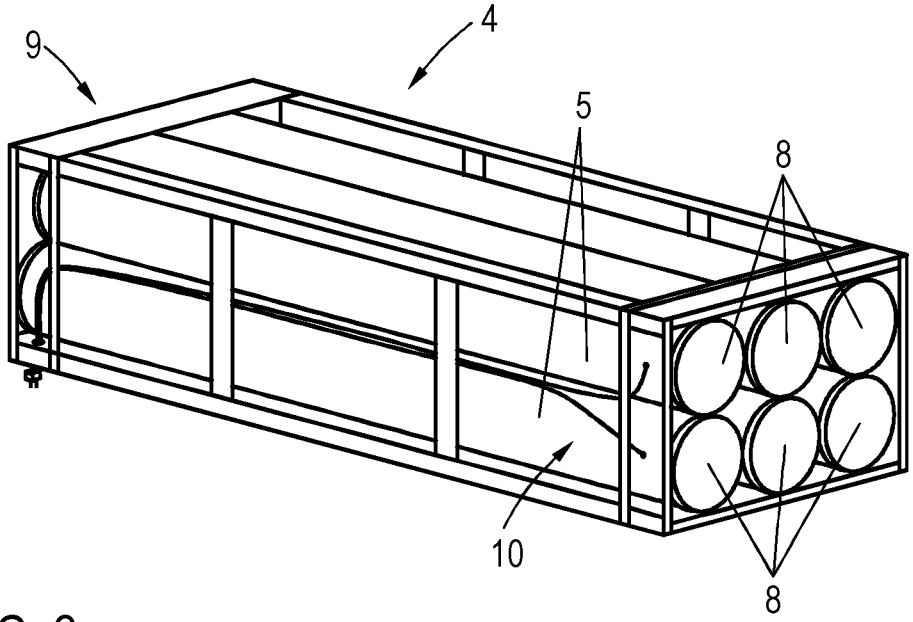
FIG. 2 is a perspective view of a launcher battery according to the invention for the launcher device from FIG. 1.

Such a launcher battery 4 is inserted, starting from its rear end 9, into the corresponding receptacle 3 from the front, that is to say coming from the right in FIG. 2, that is to say that, in the inserted position, the covers 8 are exposed above the missiles 7 on the right-hand side, see FIG. 1. Firing is also performed toward this side. That is to say, in the case of launching a missile from one of the launch tubes 5, the missile exits towards the right-hand side. It is necessarily the case here that the discharge jet from the missile 7 strikes the adjacent covers 8 of the launch tubes 5 that have not yet been fired, or churns up the ground surface upon firing, etc. This may lead to a situation whereby one of the hitherto intact covers 8 is damaged thereby, such that firing the missile 7 inserted in this launch tube 5 may become problematic.

For this purpose, according to the invention, each launch tube 5 is provided with a device or detector 10 for detecting damage to the respective cover 8 closing off the launch tube 5 in the firing direction. FIG. 3 illustrates such a launch tube 5 provided with a device 10 in principle. The device 10 is configured to detect any incidence of light into the launch tube 5. Such an incidence of light may only be caused by damage to the cover 8 following previous firing of a missile of the corresponding launcher battery 4. If the device 10 thus detects any incidence of light in the associated launch tube 5, then it may be assumed with certainty that the corresponding cover 8 is damaged, which may then be responded to.

FIG. 4 shows a first exemplary embodiment of such a device 10. What is shown is the launch tube 5 and the cover 8 placed on top thereof, which sits on the launch tube 5 in a hermetically sealed manner. In the tube wall of the launch tube 5, a sensor element 12, containing a photodiode 13 directed towards the inside of the tube, is inserted into a bore 11 adjacent to the cover 8. The sensor element 12 is received in the bore 11 so as to be hermetically tight, that is to say in a manner avoiding any incidence of light. The sensor element 12 is able to be connected to a connector device, not shown in more detail, via a connecting line 14 with an associated connector plug 15, via which connector device wired or wireless communication to a control and/or display device 16 that controls automatic firing operation, for example, and is shown here only by way of example, is then possible.

Even though a connecting plug 15 is shown in FIG. 4, there is also the option of guiding the connecting line 14 to a transmission device 17, shown only in dashed form here, using which transmission device the signal of the sensor element 12 is able to be transmitted wirelessly to the control and/or display device 16. Both a wired and a wireless mode of communication are possible.

FIG. 5 shows one alternative of a corresponding detection device 10. The launch tube 5 and the cover 8 are again shown. The end of an optical waveguide 18 is in this case inserted into a bore 11, which optical waveguide thus protrudes into the inside of the tube with its free end 19. The optical waveguide 18 is in this case coupled to a sensor element 20. Any light received by the optical waveguide 18, which light, as mentioned, is only able to penetrate if the cover 8 is damaged, is thus supplied by the optical waveguide 18 to the sensor element 20, for example again comprising one or more photodiodes. This sensor element 20 may then again be connected via a connecting line 14 to a connecting plug 15 or, as an alternative, as shown in dashed form, to a transmission device 17 for wireless communication to the control and/or display device 16, shown here only by way of example.

In the exemplary embodiment according to FIG. 4, a plurality of optical waveguides 18 open out on the sensor element 20. Each launch tube 5 is assigned a separate optical waveguide 18, that is to say, in this configuration, the optical waveguides 18 of all six, for example, launch tubes 5 of a launcher battery 4 are guided in bundled form to a common sensor element 20. The sensor element is configured such that it is able to exactly resolve the optical waveguide 18 from which the signal comes, that is to say which launch tube 5 is associated. The resolution on the side of the sensor element 20 or else also on the side of the control and/or display device 16 is in this case such that it is able to be detected which launch tube 5 was fired, that is to say which one is missing the cover 8, and which one has not yet been fired. Since the sensor elements 12 respectively naturally deliver a light signal through the optical waveguides 18 after firing has taken place, the sensor signal is thereby able to be suppressed, and only the signals of launch tubes 5 that have not yet been fired may be taken into account. If an incidence of light is detected in relation to a launch tube 5 that has not yet been fired, then damage is again able to be detected with certainty.

Figure 6:
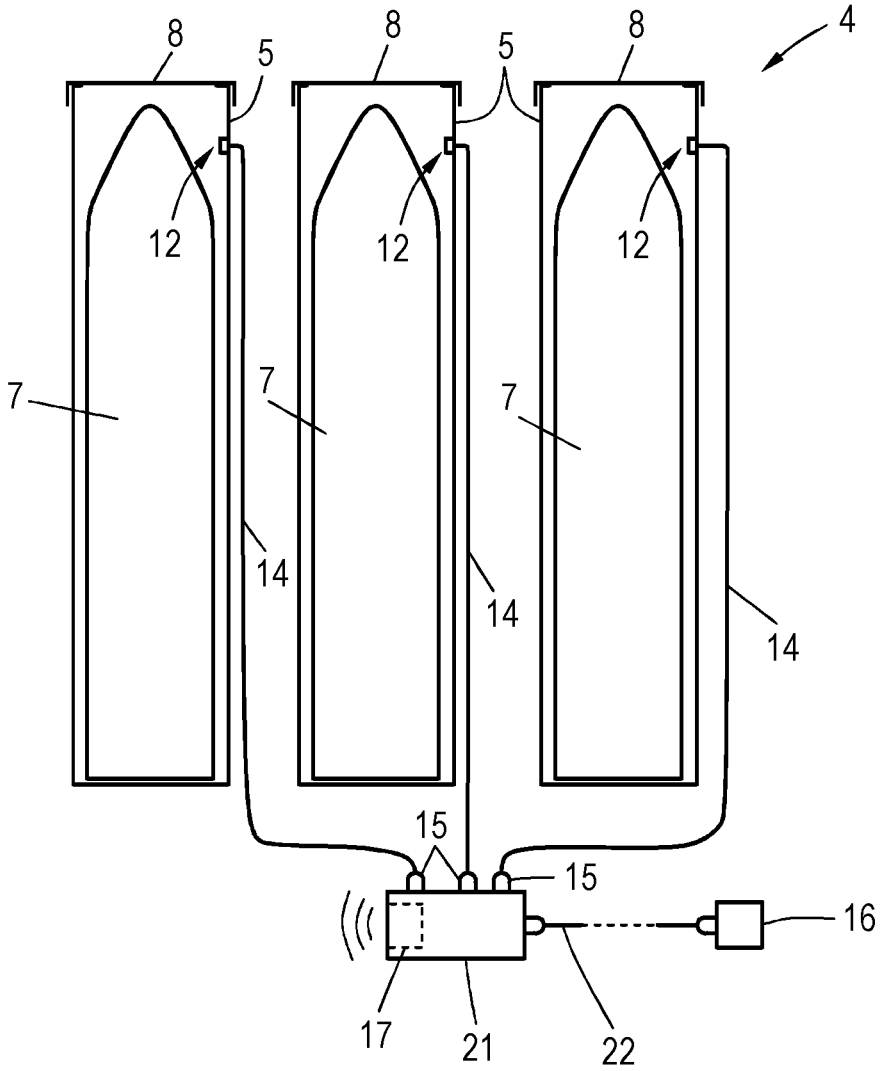
FIG. 6 is a basic illustration of a launcher battery having sensor elements integrated on the tube side and connecting lines and a common connector device.

FIG. 6 shows a basic illustration of the launcher battery 4 containing three launch tubes 5. In the exemplary embodiment shown, it should be assumed that each launch tube 5 is provided with a sensor element 12, that is to say a separate photodiode or the like, wherein the respective sensor element 12 is connected to a respective connecting plug 15 via a connecting line 14. The connecting plugs 15 in this exemplary embodiment are plugged in, in bundled form, to a connector device 21. The connector device 21 then serves as an interface for connecting a further connecting line 22, which is routed by way of example to the control and/or display device 16. It is thus provided as a pure connecting line for communicating the corresponding sensor signals. As an alternative, shown in dashed form, it is possible to integrate a transmission device 17 into the connector device 21, by way of which it is possible to achieve wireless communication to the control and/or display device 16.

Figure 7:
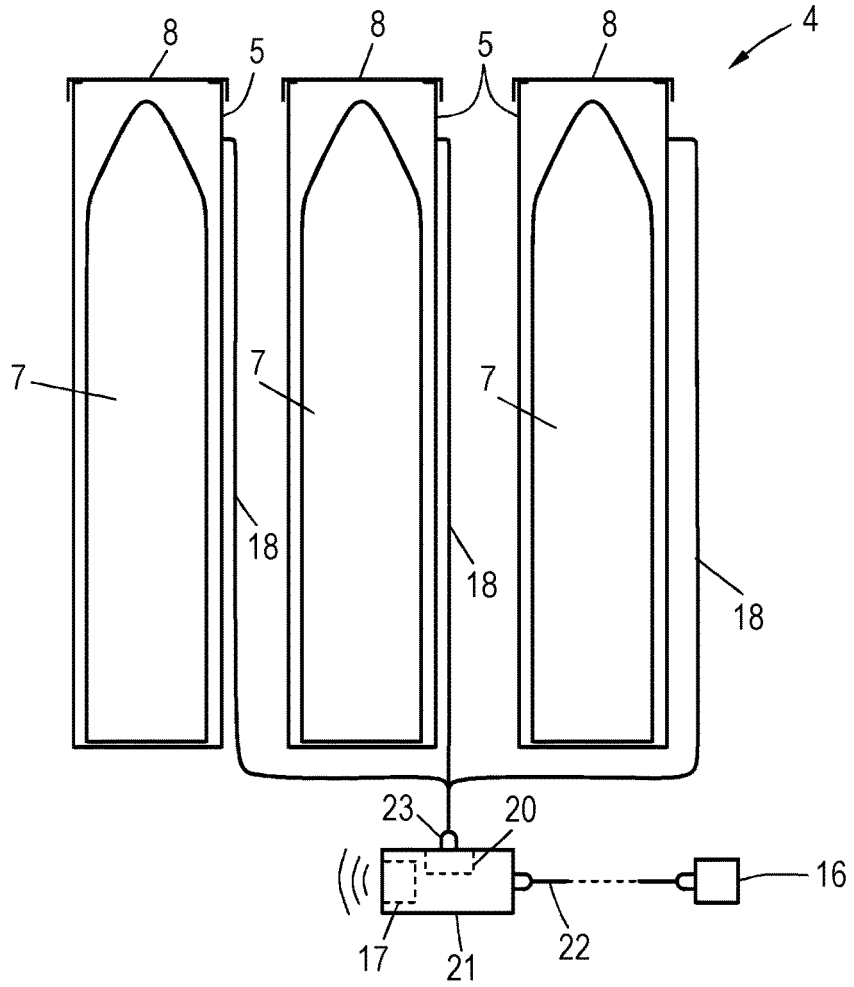
FIG. 7 is a basic illustration similar to FIG. 6, but with bundled optical waveguides, an associated sensor element and a connector device.

FIG. 7 shows the configuration of an alternative launcher battery 4, again containing three launch tubes 5, each of which is hermetically closed off by the covers 8. In this configuration, an optical waveguide 18 is in each case inserted into the launch tube 5. The optical waveguides 18 are bundled and open out in a common coupling or plug connector 23 that is connected to a connector device 21. The sensor element 20, which performs the corresponding signal detection and possibly also resolution and assignment to the individual launch tubes 5, is associated here. A connecting line 22 again goes away from the connector device 21, via which connecting line the connection to the control and/or display device 16 is created. In this case too, as an alternative, indicated in dashed form, it is possible to integrate a transmission device for wirelessly communicating the corresponding sensor signals detected, or else also resolved and assigned in a manner specific to the tube, by the sensor element 20 to the control and/or display device 16.

Figure 8:
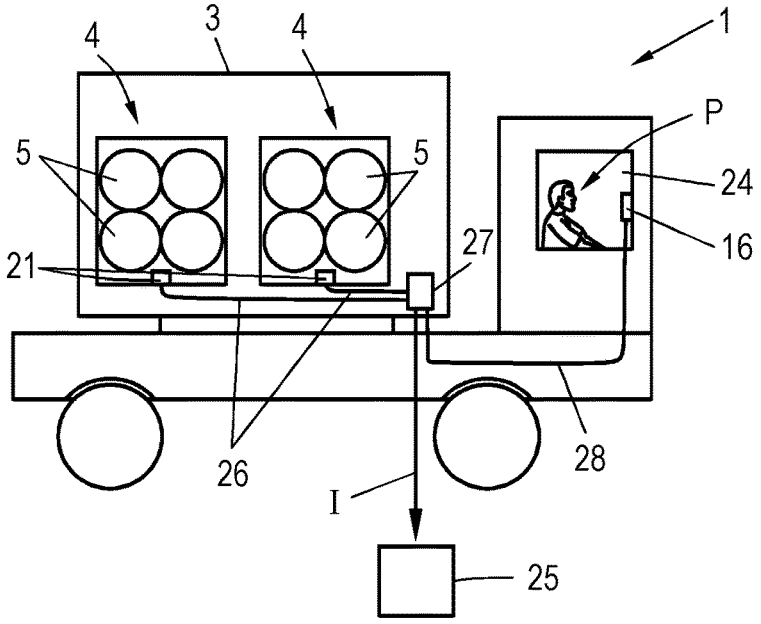
FIG. 8 is a side view of a launcher device having integrated launcher batteries and a control and/or display device situated in the driver's cabin.

Lastly, FIG. 8 shows a basic illustration of a launcher device 1, in which, again by way of example, two launcher batteries 4, in this case each containing four launch tubes 5, are received in the receptacle 3. The launch tubes 5 are all equipped with the corresponding devices 10 for detecting cover damage. In the launcher batteries 4 according to FIG. 8, a corresponding connector device 21 is in each case provided on the battery side, which connector devices are connected to a second connector device 27, provided on the receptacle 3 and containing for example the actual evaluation electronics, via corresponding connecting lines 26. A further connecting line 28 goes from the second connector device 27 to the control and/or display device 16. In the exemplary embodiment shown, this further connecting line is received in the driver's cabin 24, in which a person P for example operating the launcher device 1 is sitting. The person P sitting in the driver's cabin 24 may for example be supplied with an optical signal display on the corresponding display device, which signal display indicates any damage, or which signal display also permanently indicates the functionality of the launcher batteries 4, or the like. The control and/or display device 16 may in this case itself be capable of automatically intervening in the launcher operation in the case of detected damage detection and thus to interrupt said operation, that is to say that the control and/or display device 16 is either additionally configured to control the entire launcher operation, or it communicates with a corresponding control device that performs this.

As illustrated by the arrow I, a preferably wireless communication connection to an external control station 25 is also possible, at which control station optical signal inspection on a corresponding display is possible, for example. Corresponding signal detection may also thereby be performed from an external site.

The following is a summary list of reference numerals and the corresponding structure used in the above description of the invention:

1 Launcher device
2 Vehicle
3 Receptacle device
4 Launcher battery
5 Launch tube
6 Ammunition
7 Missile
8 Cover
9 Rear end
10 Device or Detector
11 Bore
12 Sensor element
13 Photodiode
14 Connecting line
15 Connector plug
16 Display device
17 Transmission device
18 Optical waveguide
19 Free end
20 Sensor element
21 Connector device
22 Connecting line
23 Plug connector
24 Driver's cabin
25 Control station
26 Connecting line
27 Connector device
28 Connecting line
P Person
I Arrow

The invention claimed is:

1. A launcher device for launching ammunition or weapons provided with primers, the launcher device comprising:
covers;
a plurality of launch tubes combined so as to form a launcher battery, each of said launch tubes is loaded with the ammunition or a weapon, and each of said launch tubes is closed off by one of said covers; and
a detector for detecting damage to said covers closing off said launch tubes, said detector being configured for detecting an incidence of light into a respective one of said launch tubes resulting from damage to one of said covers.

2. The launcher device according to claim 1,
further comprising a control and/or display device disposed external to said launch tubes; and
wherein said detector has sensor elements for detecting the incidence of light, at least one of said sensor elements is disposed in each of said launch tubes, said sensor elements communicate with said control and/or display device.

3. The launcher device according to claim 2, wherein at least one of said sensor elements is a photodiode.

4. The launcher device according to claim 2, wherein at least one of said sensor elements communicates with said control and/or display device in a wired manner or wirelessly.

5. The launcher device according to claim 4,
further comprising a first common connector;
further comprising connecting lines;
further comprising a further connecting line;
further comprising a second connector that is connected to said control and/or display device via said further connecting line; and
wherein said at least one sensor element is a wired communicating sensor element and is connected to said first common connector via said connecting lines, said first common connector is able to be connected releasably to said second connector.

6. The launcher device according to claim 5, wherein:
said first common connector and said second connector need to be connected manually; or
said first common connector and said second connector are able to be connected automatically when said launcher battery is inserted into a battery receptacle.

7. The launcher device according to claim 4,
further comprising a transmitter disposed on said launcher battery; and
wherein said at least one sensor element is a wirelessly communicating sensor element connected to said transmitter, using said transmitter sensor signals are able to be transmitted to said control and/or display device or a reception device assigned thereto.

8. The launcher device according to claim 2, wherein said control and/or display device which detects or indicates any damage is disposed in a driver's cabin of a vehicle transporting said launcher battery.

9. The launcher device according to claim 1,
further comprising a control and/or display device disposed external to said launch tubes;
wherein said detector has sensor elements for detecting the incidence of light, at least one of said sensor elements is disposed in each of said launch tubes; and
further comprising optical waveguides, one of said optical waveguides is disposed or inserted in each of said launch tubes, said optical waveguide is connected to said at least one sensor element for detecting the incidence of light, said at least one sensor element communicates with said control and/or display device.

10. The launcher device according to claim 9, wherein:
each of said optical waveguides is connected to a separate one of said sensor elements; or
at least two of said optical waveguides are connected to a common one of said sensor elements; or
all of said of said optical waveguides are connected to a common one of said sensor elements.

11. The launcher device according to claim 9, wherein:
said launch tubes each have a tube wall; and
one of said sensor elements or said optical waveguides is disposed on or in said tube wall.

12. The launcher device according to claim 11, wherein said at least one sensor element or said optical waveguide is disposed adjacent to one of said covers or opens out adjacent to one of said covers.

13. The launcher device according to claim 1, wherein when damage to one of said covers is detected further launching operations are able to be automatically or manually interrupted.

14. A launcher battery for a launcher device, the launcher battery comprising:
covers;
a plurality of combined launch tubes, each of said launch tubes is loaded with ammunition or a weapon, and each of said launch tubes is closed off by one of said covers; and
a detector for detecting damage to said covers closing off said launch tubes, said detector configured for detecting an incidence of light into a respective launch tube of said launch tubes resulting from damage to a respective cover of said covers.

15. The launcher battery according to claim 14, wherein said detector has at least one sensor element for sensing the incidence of light disposed in each of said launch tubes.

16. The launcher battery according to claim 15, wherein said sensor element is a photodiode.

17. The launcher battery according to claim 15, wherein:
said launch tubes each have a tube wall; and
said sensor element or said optical waveguide is disposed on or in said tube wall.

18. The launcher battery according to claim 17, wherein said sensor element or said optical waveguide is disposed adjacent to said respective cover or opens out adjacent to said respective cover.

19. The launcher battery according to claim 15,
further comprising communication means for wired or wireless communication; and
wherein said sensor element is assigned said communication means for wired or wireless communication with an external control and/or display device.

20. The launcher battery according to claim 19, further comprising a first common connector;
further comprising connecting lines;
further comprising a further connecting line;
further comprising a second connector that is connected to said control and/or display device via said further connecting line; and
wherein said sensor element is a wired communicating sensor element connected to said first common connector via said connecting lines, said first common connector is able to be connected releasably to said second connector.

21. The launcher battery according to claim 20, wherein:

said first common connector is configured for manual connection;

or said first common connector is configured for automatic connection when inserting the launcher battery into a battery receptacle.

22. The launcher battery according to claim 19, further comprising a transmitter; and wherein said sensor element is a wirelessly communicating sensor element connected to said transmitter, using said transmitter sensor signals are able to be transmitted to said control and/or display device or a reception device assigned thereto.

23. The launcher battery according to claim 14, further comprising an optical waveguide disposed in each of said launch tubes or inserted therein, said optical waveguide is connected to said sensor element detecting the incidence of light.

24. The launcher battery according to claim 23, wherein:

each said optical waveguide is connected to a separate said sensor element; or at least two optical waveguides are connected to a common said sensor element; or all said optical waveguides are connected to a common said sensor element.

* * * * *